US005366288A

United States Patent [19]

Dahllöf et al.

[11] Patent Number: 5,366,288

[45] Date of Patent: Nov. 22, 1994

[54] APPARATUS FOR MIXING A SUSPENSION OF CELLULOSIC FIBROUS MATERIAL AND FLUID

[75] Inventors: Hakan Dahllöf, Edsvalla; Rolf Ekholm; Ulf Jansson, both of Karlstad, all of Sweden

[73] Assignee: Kamyr Aktiebolag, Karlstad, Sweden

[21] Appl. No.: 117,078

[22] PCT Filed: Jan. 30, 1992

[86] PCT No.: PCT/SE92/00058

§ 371 Date: Sep. 9, 1993

§ 102(e) Date: Sep. 9, 1993

[87] PCT Pub. No.: WO92/16288

PCT Pub. Date: Oct. 1, 1992

[30] Foreign Application Priority Data

Mar. 20, 1991 [SE] Sweden ..... 9100838

[51] Int. Cl.[5] ..... B01F 5/06

[52] U.S. Cl. ..... 366/176; 366/338

[58] Field of Search ..... 366/176, 348, 349, 336, 366/337, 338, 340, 150, 151

[56] References Cited

U.S. PATENT DOCUMENTS 4,352,573 10/1982 Pandolfe ..... 366/176
4,660,986 4/1987 Leschonski ..... 366/176
4,952,067 8/1990 Dallas ..... 366/176

*Primary Examiner*—Robert W. Jenkins
*Attorney, Agent, or Firm*—Cushman, Darby & Cushman

[57] ABSTRACT

An apparatus for mixing pulp and fluid includes a housing with a center line an inlet and outlet for the pulp; an inlet for the supply of fluid and two walls are arranged in the housing and have opposite sides which between them define a gap-shaped surface through which the pulp will flow and has inlet and outlet openings communicating with the pulp inlet and outlet respectively; the walls are arranged concentrically in the housing and are non-rotatable with opposite sides thereof being arranged to extend around the central line of the housing, spaced therefrom, the gap-shaped space thus acquiring the shape of a concentric annular gap; the annular gap has an extension in excess of 20 mm in the main flow direction of the medium flowing through it; there is a distribution chamber communicating with and arranged axially upstream of the annular gap in order to distribute the pulp uniformly around the entire concentric inlet opening of the annular gap.

18 Claims, 5 Drawing Sheets

APPARATUS FOR MIXING A SUSPENSION OF CELLULOSIC FIBROUS MATERIAL AND FLUID

The present invention relates to an apparatus for mixing a suspension of a cellulosic fibrous material and a fluid, comprising a housing with a center line and inlet and outlet for the fibre suspension, said inlet and outlet being spaced axially from each other with respect to the center line of the housing; inlet means for the supply of said fluid to the fibre suspension; and two cooperating wall means arranged in the housing at a distance from each other, said wall means having sides facing each other which between them define a gap-shaped space through which the fibre suspension shall flow and has an inlet opening and an outlet opening communicating with said inlet and outlet, respectively, for the fibre suspension.

BACKGROUND OF THE INVENTION

Description of the Prior Art

Apparatus for mixing pulp and fluid, e.g. oxygen or ozone, is known through SE 436 652, SE 459 904, SE 462 857, U.S. Pat. No. 3,095,349 and U.S. Pat. No. 4,886,577, for instance. In the known apparatus one of the gap-forming wall elements is arranged to rotate and therefore requires a driving motor and foundation for its installation. These apparatus therefore require relatively much place and the installation is relatively time-consuming. Furthermore, it is impossible to automatically alter the through-flow area of the gap during operation in order to set optimal mixing conditions and capacity or to remove any clogged fibre material without dismantling the apparatus.

When bleaching pulp with ozone, for instance, relatively large amounts of gas containing ozone must be added since the carrier gas can only contain limited quantities of ozone. Furthermore, it must be taken into account that ozone reacts extremely quickly with the pulp and must therefore be mixed with it so that if possible all parts of the pulp are treated with ozone. In the known apparatus as described in the above-mentioned patent specification relating to mixing in ozone, the ozone is supplied to the pulp at one or more points as it flows past the supply points so that certain parts of the pulp are mixed with ozone while other parts are not treated with any ozone, or only with a limited quantity due to insufficient mixing effect in the apparatus and/or because all or almost all the ozone has been consumed when the carrier gas reaches these other parts of the pulp as well.

SUMMARY OF THE INVENTION

The object of the present invention is to greatly reduce the above-mentioned problems and to achieve an improved apparatus for mixing pulp and fluid, which does not have a motor-driven rotating part, so that the apparatus is compact and simple in structure as well as being easy install; which enables large quantities of fluid to be supplied continuously to the pulp so that at least the majority of the pulp is supplied with fluid and this is mixed with the pulp during one and the same brief period of time, e.g. from almost 0 to 2 seconds; and which preferably also enables automatic control of the gap during operation in order to alter the through-flow area of the gap and the flow through the apparatus.

The invention is substantially characterized in that the wall means are arranged concentrically in the housing and are non-rotatable, said opposite sides thereof being arranged to extend around the center line of the housing. spaced therefrom, the gap-shaped space thus acquiring the shape of a concentric annular gap, which annular gap preferably has an extension in excess of 20 mm in the main flow direction of the medium flowing through it, and that the housing includes a distribution chamber communicating with and being arranged axially upstream of the annular gap in order to distribute the fibre suspension uniformly around the entire concentric inlet opening of the annular gap.

The invention will be described further with reference to the accompanying drawings.

DETAILED DESCRIPTION OF THE INVENTION

Figure 1:
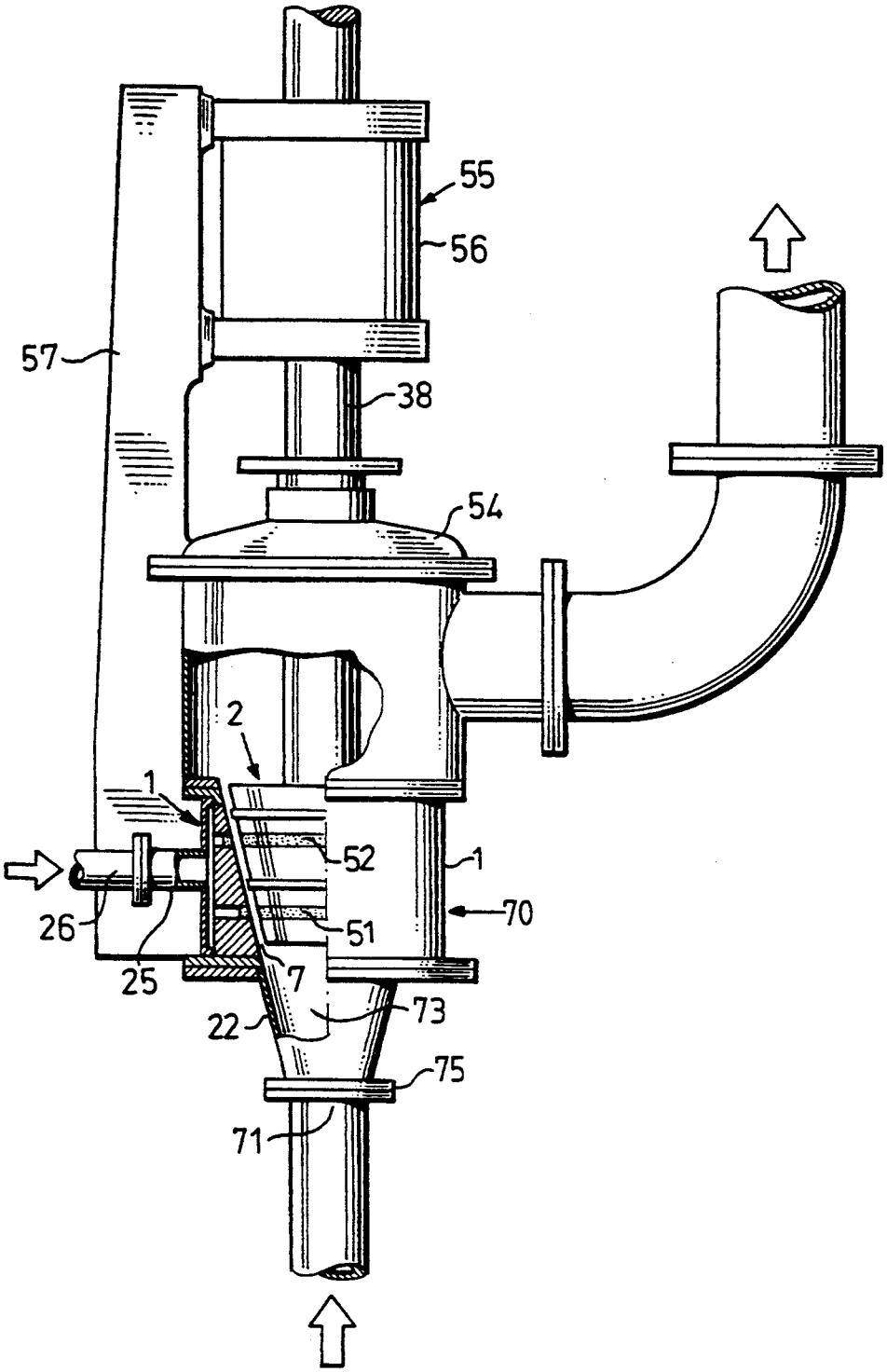
FIG. 1 is a side view, partly in section, of an apparatus according to a first embodiment of the invention.

The apparatus shown in FIG. 1 comprises a housing 70 with a center line 11, an inlet 71 and an outlet 72 for a fibre suspension, e.g. pulp. The inlet 71 and outlet 72 are spaced axially from each other with respect to the center line 11 of the housing. The apparatus is provided with two wall means 1, 2, separate from each other and secured against rotation, said wall means having cooperating sides 3, 4 facing each other and forming a gap-shaped space 7 between them which is continuous in all directions and through which the pulp shall flow in fluidized state. The space 7 has an inlet opening 5 and an outlet opening 6 which communicate with said inlet 71 and outlet 72, respectively. The apparatus also includes inlet means 8 for the supply of fluid to the pulp. In the embodiment shown in FIGS. 1 and 2 the inlet means 8 are arranged to introduce fluid into the space 7 and said inlet means 8 preferably include distributing means 9 arranged to distribute fluid from the sides 3, 4 of the wall means 1, 2 at least within a section of each side 3, 4 extending continuously in a direction transverse to the flow direction of the fibre suspension so that fluid is supplied to most of the fibre suspension passing along the sides 3, 4 of the wall means 1, 2 and penetrates into the pulp to be homogenously mixed with it. Alternatively only one of the wall means is provided with such inlet means 8 for the fluid. According to the invention, the non-rotating wall means 1, 2 are arranged concentrically in the housing 70, their opposite sides 3, 4 located radially outside each other being so arranged that these sides extend around the center line 11 of the housing, spaced therefrom. The gap-shaped space thus acquires the shape of a concentric annular gap 7. The housing 70 also includes a distribution chamber 73 which communicates with and is arranged axially upstream of the annular gap 7 for uniform distribution of the pulp around the entire concentric inlet opening 5 of the annular gap 7. In the embodiment shown in FIGS. 1 and 2 the annular gap 7, seen in a longitudinal section through the housing, extends linearly between the inlet opening 5 and the outlet opening 6 in a direction forming an acute angle with the center line 11 of the apparatus, said direction corresponding to the flow direction of the fibre suspension through the annular gap. Generally speaking, however, this angle may be from a value in excess of 0°, i.e. excluding 0°, up to 90°, preferably 10°–80° and most preferably 30°–50°, which means that the diameter of the annular gap 7 increases in the flow direction of the pulp. The wall means 1, 2 are arranged radially outside each other to form a radially inner wall element 13 and a radially outer wall element 12. The inner wall element 13 is supported by a coaxially arranged elongate support member 10 slidingly at one end or the upper end 54 of the housing to permit axial displacement of the inner wall element 13. For this purpose the apparatus includes an actuator 55 cooperating with the support means 10 to permit axial displacement of the inner wall element 13 in relation to the outer wall element 12 in order to control the through-flow area of the annular gap 7, i.e. to control the distance between the sides 3, 4 of the wall elements at each point along the annular gap 7 seen in flow direction of the pulp. The inner side 3 of the outer wall element 12 has greater conicity than the inner side 4 of the inner wall element 13, thus giving the gap 7 a diverging form seen in the flow direction of the pulp so that the width of the annular gap 7 is least at the inlet opening 5 and greatest at the outlet opening 6. In other words, the through-flow area of the gap 7 increases constantly in the direction from the inlet opening 5 to the outlet opening 6. Since the wall elements 12, 13 are displaceable in relation to each other it will be understood that there is no connection between them, and the annular gap 7 is thus entirely free from any connecting elements between the sides 3, 4.

The apparatus is provided with two inner annular flanges 14, 15 supporting the outer wall element 12 between them, said element comprising a cylindrical casing 16 with radially inwardly directed end pieces 17, 18 which are connected to the flanges 14, 15 and provided with seals 19 to seal against the flanges. The inner flanges 14, 15 are permanently fitted on two opposite, outer flanges 20, 21 of which the flange 20 is welded to a conical pipe member 22 including said distribution chamber 73 and which, via the lower, flange-shaped end wall 75 of the housing, is connected to the inlet 71 which in turn is connected to the outlet-of a pump (not shown), while the flange 21 is welded to the bottom of a vessel 24, e.g. a reactor, which may be considered to constitute a part of the housing 70.

Figure 2:
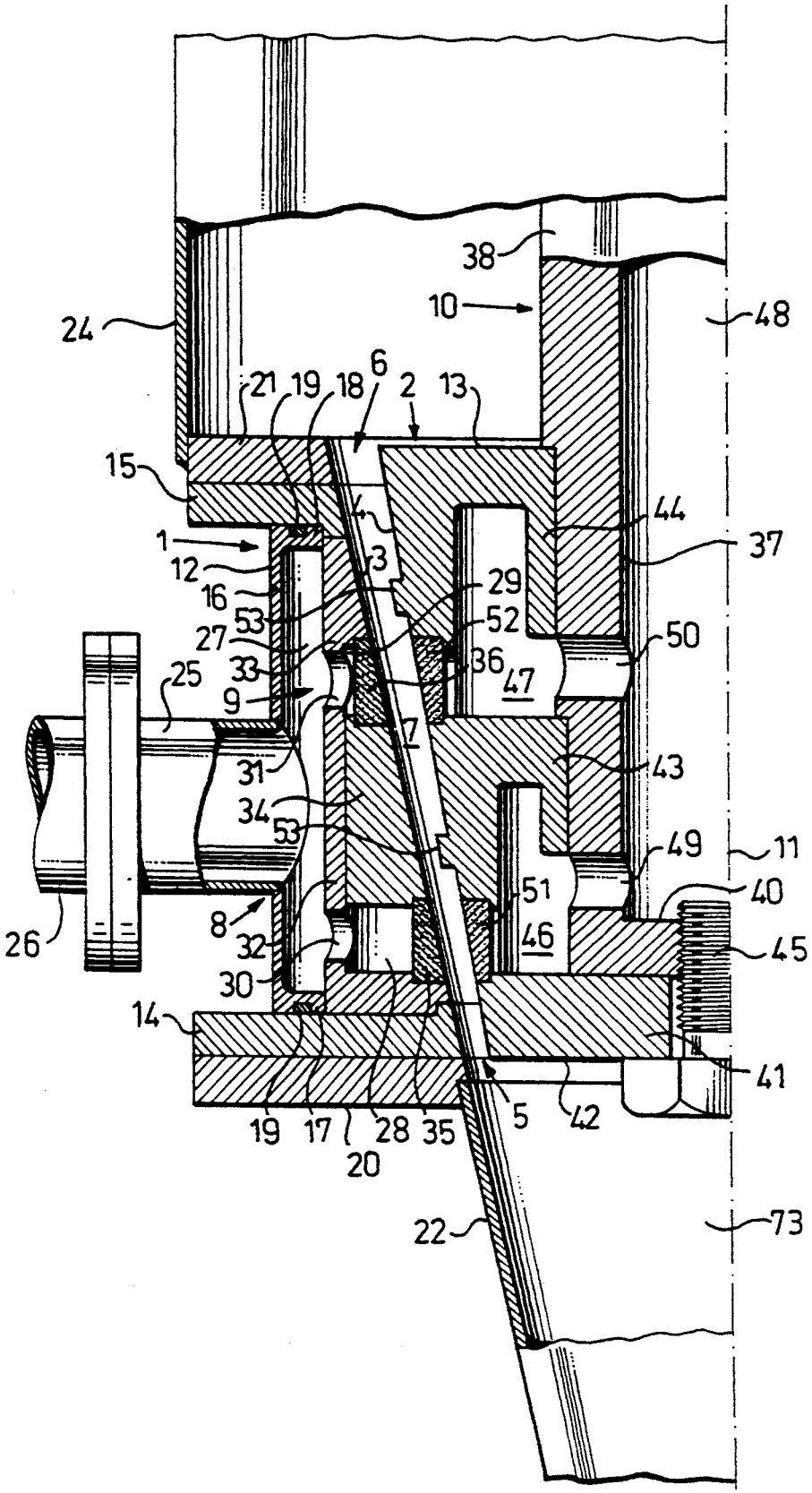
FIG. 2 shows a longitudinal section through parts of the apparatus according to FIG. 1.

As can be seen more clearly in FIG. 2, the inlet means for fluid comprises a pipe connection 25 directed radially on the casing 16 and connected to a conduit 26 for the supply of fluid from a fluid supply. The casing 16 surrounds an annular chamber 27 which communicates with the pipe connection 25. The fluid-distributing means comprises two annular distribution cavities 28, 29, spaced apart and communicating with said chamber 27 via a plurality of apertures 30, 31 distributed uniformly around the circumference. The outer wall element 12 comprises two rings 32, 33 arranged close together, in which said apertures 30, 31 are arranged, and a spacer 34 surrounded by the rings. The radial sides of the spacer 34 facing away from each other, together with the opposing radial sides of respective rings 32, 33, define said annular distribution spaces 28, 29. Finally, the fluid-distributing means 9 comprises two dosage rings 36 received in two recesses forming seats in the wall element 12, or more specifically in the spacer 34 and the rings 32, 33. The dosage rings 35, 36 are pervious to fluid and may consist, for instance, of sintered, cast material or perforated material such as sheet-metal.

In the inner wall element 13 the fluid-inlet means 8 comprises a hollow central body 37 which constitutes the end portion of said support member 10 in the form of an elongate pipe 38 connected to a conduit 39 for the supply of fluid from a fluid supply through a channel 48 in the pipe 38. The central body 37 supports a circular end plate 40 which is screwed by means of a bolt 45 to the end wall 41 which closes said central body and has a larger diameter than the central body 37 so that a collar 42 is formed. The inner wall element 13 also includes two rings 43, 44 located axially one after the other and at a specific distance from each other, surrounding the central body 37 and permanently secured thereto. The fluid-distributing means 9 of the inner wall element 13 comprise annular distribution cavities 46, 47 spaced from each other, and a plurality of apertures 49, 50 distributed uniformly around the circumference and radially inside the distribution cavities 46, 47 in the central body 37 so that the distribution cavities 46, 47 communicate with the central channel 48 via said apertures 49, 50, the latter therefore being arranged in two circular paths. The distribution spaces 46, 47 are defined by opposing side surfaces of the collar 42 and the rings 43, 44 and may include axial recesses in the rings 43, 44 as shown. Finally, the fluid-distributing means 9 comprises two dosage rings 51, 52 received in two recesses forming seats in the wall element 13, or more specifically in the rings 43, 44 and the collar 42. The dosage rings 51, 52 are pervious to fluid and suitably consist of the same material as the dosage rings 35, 36 described earlier.

The inner, conical side 4 of the inner wall element 13 is made in one piece with or provided with two annular protuberances 53 in the gap 7 in order to produce a favorable turbulence promoting effect.

Said pipe 38 extends through the reaction vessel 24 and out through its top wall 54. The pipe cooperates or is in engagement with said actuator 55 which in the embodiment shown consists of a single acting cylinder 56 fitted on a stand 57 which also carries the vessel 24. The cylinder 56 has a piston 58 permanently secured to the pipe 38 which thus forms a piston rod for to and fro movement. Like the top wall 54 of the vessel 24, the end walls of the cylinder 56 are provided with suitable sealing and sliding means.

The upper end of the pipe 38 is located above the cylinder 56 and is connected to said conduit 39. The upper side or pressure chamber of the cylinder 56 communicates via a connection 59 with an accumulator 60 and to this connection a conduit 61 is connected, containing a safety valve 62. Pressure medium, preferably air, is supplied to the upper side of the cylinder through a conduit 63 containing a valve 64. The lower side of the cylinder 56 communicates with the atmosphere via a conduit 65. Said valve 64 is governed by a control device 66 which continuously measures or obtaines measured values via connections 67, 68 of the pressure in the pulp upstream and downstream of the annular gap 7 in order to record a pressure difference. The control device 66 compares the recorded pressure difference with a predetermined value (set value), which is set depending on prevailing production conditions such as temperature, consistency, type of pulp and capacity. The set value is preferably adjusted automatically. The control device 66 will open or close the valve 64 depending on the pressure difference measured in comparison with the set value. Thus, if the pressure increases on the inlet side 73 during operation, which may be due to clogging of the gap 7, the control device 66 will measure a pressure difference greater than that predetermined and will therefore emit a signal to close the valve 64. If the pressure on the inlet side 73 increases further, the pressure in the cylinder 55 will also increase which will cause the safety valve 62 to open, whereupon the pipe 38 and the wall element 13 carried by it can be displaced upwardly by the increased pressure in the distribution chamber 73 of the conical pipe section 22. The width of the gap 7 will thus increase and the increasing through-flow area thereby achieved will free the clogged pulp so that a larger flow of pulp is obtained until the pressure on the inlet side falls and the pressure difference once again becomes normal. The safety valve 62 closes and the valve 64 opens once the pressure difference has fallen below the desired value, i.e. the pressure in the conical pipe section 22 has fallen and the width of the annular gap 7 should therefore decrease again, which is achieved by the pressure in the cylinder 55 increasing so that the pipe 38 and wall element 13 are pressed down. It will be understood that when the valve 64 is closed and the preset pressure difference is measured, the accumulator 60 will balance the force exerted by the pulp on the inner wall element 13. The presence of the accumulator 60 in the pressure system also ensures that the movements of the pipe 38 and wall element 13 are not jerky, but smoothly follow the constant pressure differences normally obtained and measured in comparison with the set value.

Figure 3:
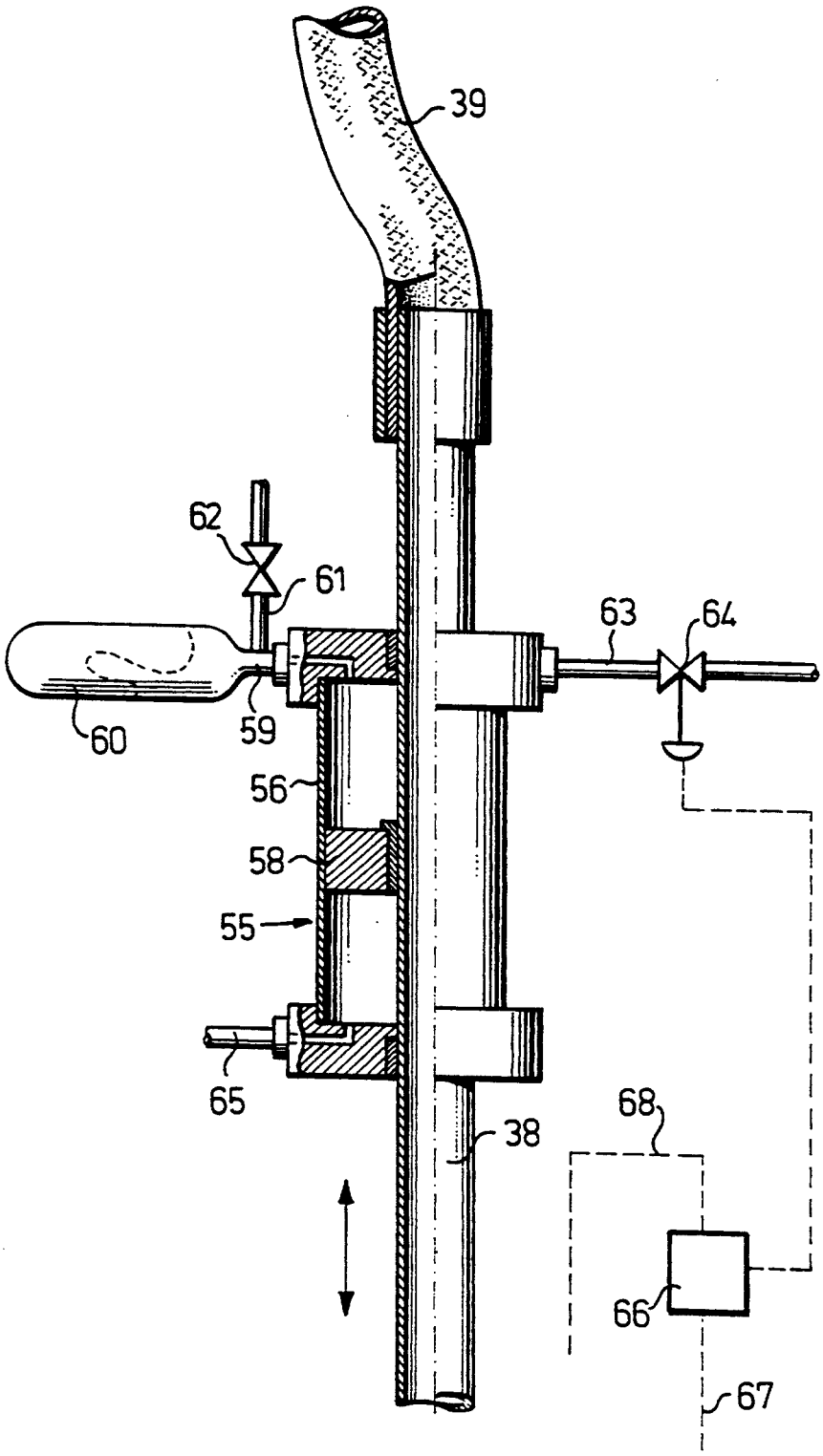
FIG. 3 is a side view, partly in section, of control means and actuator in the apparatus according to FIG. 1.
Figure 4:
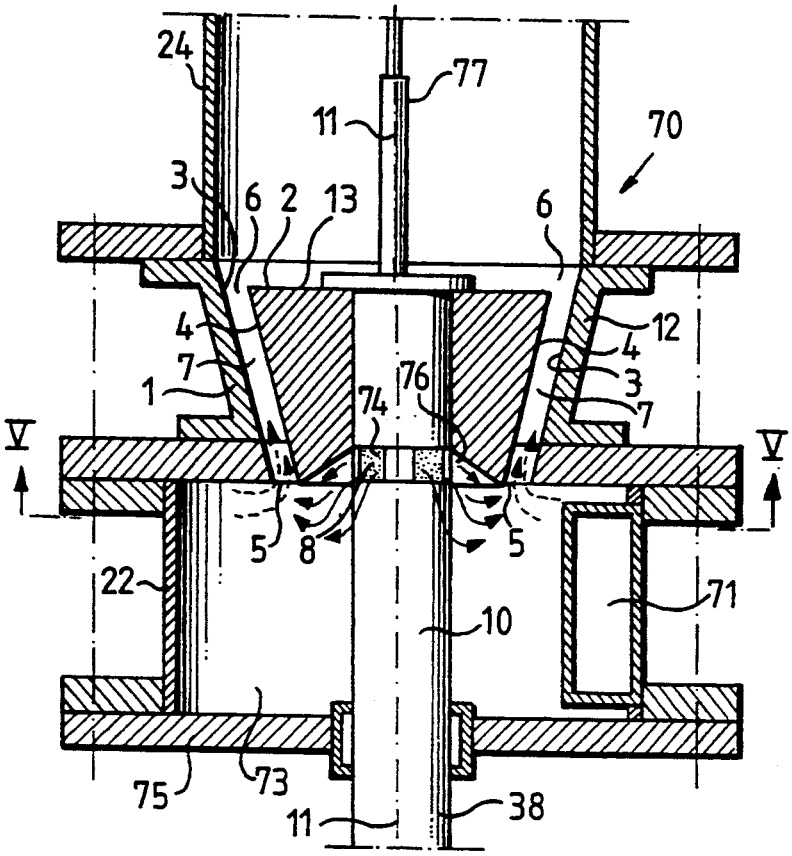
FIG. 4 is a longitudinal section through a second embodiment of the apparatus according to the invention.
Figure 5:
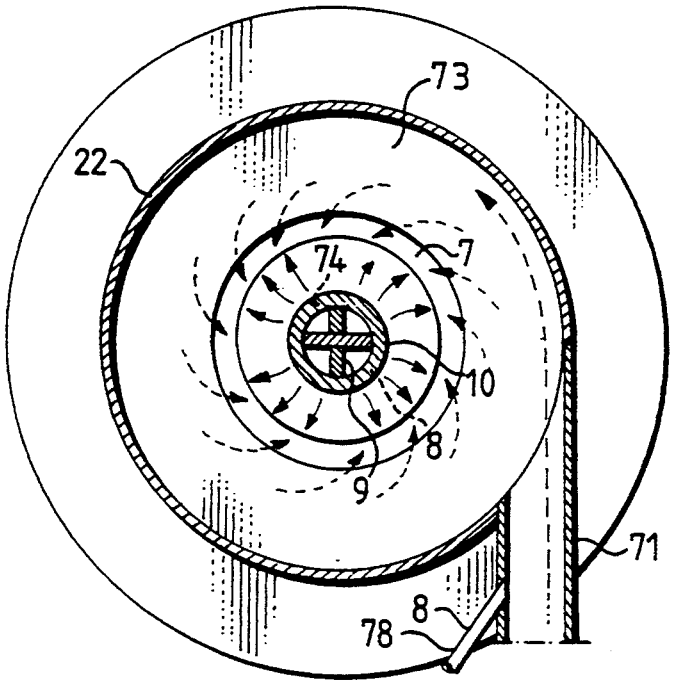
FIG. 5 is a cross section along the line IV–IV in FIG. 4.

FIGS. 4 and 5 show schematically another embodiment of the mixing apparatus according to the invention. The same designations are used for parts equivalent to those in the first embodiment described. In this case the coaxial support member 10 extends down through the distribution chamber 73 instead of up through the vessel 24 as in the embodiment according to FIGS. 1–3. The control, means (not shown) and its piston rod 38 are in this case located outside the housing 70. The inlet 71 for the pulp is connected tangentially to the distribution chamber so that the pulp flows into the chamber tangentially and follows the inner side of the pipe member 22 one turn before being forced in towards the center through a number of decreasing turns. The pulp thus flows helically in towards the annular gap 7, to be distributed to this in uniform manner seen in peripheral direction. The inlet means 8 for the supply of fluid are arranged in the support member 10 acting as connecting rod, and are provided with orifices 74 along a section circumventing the connecting rod 10 which is located in the distribution chamber 73, close to the radially inner wall element 13 so that fluid flows out in a continuous zone upstream of the inlet opening 5 or the annular gap 7, to become mixed with the pulp passing by. All pulp will thus be brought into contact with fluid in a circumferential section of the pulp flow. A particularly favorable flow and mixing effect is obtained by making the lower side of the inner wall element 13 arched or directed conically inwards to produce an acute angle with the connecting rod 76. An annular pocket 76 is thus obtained into which orifices 74 emerge. The inlet opening 5 to the annular gap 7 is thus located axially below the orifices 74 so that the fluid is forced backwards to encounter the pulp flow. The orifices 74 may be provided with suitable elements which are pervious to the fluid and are made of the same material as the dosage rings described earlier. The inlet means 8 include suitable distributing means 9 for uniform distribution of fluid around the connecting rod 10 which is hollow and connected to a fluid supply as described earlier. The supply of fluid may also, or alternatively, take place through an inlet means 8 in the form of a simple supply pipe 78 which is connected to the inlet 71. Since the fluid is not supplied directly in the annular gap in the embodiment according to FIG. 4, its through-flow area does not necessarily have to increase in the direction of flow but may be constant, i.e. the annular gap 7 diverges towards its outlet opening 6.

Figure 6:
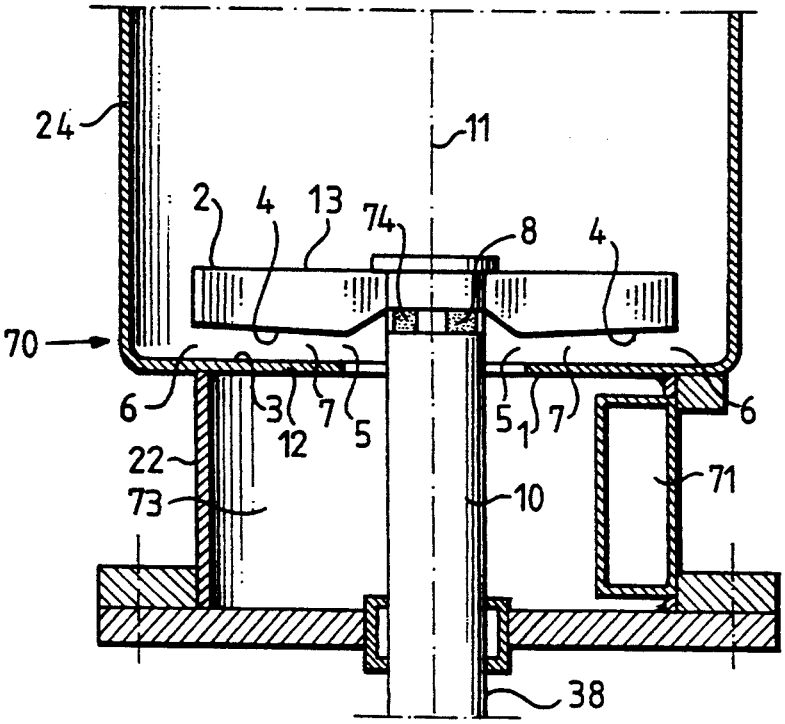
FIG. 6 is a longitudinal section through a third embodiment of the apparatus according to the invention.

FIG. 6 shows schematically another embodiment of a mixing apparatus according to the invention, in which the same designations are used for similar parts as in the embodiments described previously. In this case the annular gap 7, seen in a longitudinal section through the housing, extends linerly between the inlet opening 5 and the outlet opening 6 in a direction forming an angle of 90° with the centre line 11 of the housing 70, said direction corresponding to the flow direction of the pulp through the annular gap 7. The non-rotating wall means 1, 2 are consequently arranged axially one after the other to produce an outer wall element 12 in relation to the general flow of the pulp through the housing, said element 12 being located nearest the distribution chamber 73, and an inner wall element 13 in relation to the general flow of the pulp through the housing, said element 13 being spaced axially from the outer wall element 12. The annular gap 7 is then defined between these elements and will lie in a plane perpendicular to the centre line 11 of the housing. In this case also the lower side of the inner wall element 13 is suitably arched or conical to produce an acute angle with the connecting rod 10 so that a circumferential pocket 76 is obtained into which the orifices 74 of the fluid inlet means 8 emarge.

The embodiments described above are intended for use when it is necessary to be able to control the through-flow area of the annular gap due to varying operating conditions such as pulp consistency and clogging of the annular gap 7. However, in some cases the operating conditions may be constant and even free of problems related to clogging of the annular gap and in such installations the control means and its actuator may be omitted. An embodiment of the apparatus according to the invention for such installations is shown schematically in FIG. 7. The support member 10 for the inner wall element 13 is permanently fitted to the bottom wall 75 of the housing so that the wall element 13 is immovable in axial direction as well as being non-rotatable. In this case, therefore, the support member 10 provides an attachment means for rigid anchoring of the wall element 13.

Figure 7:
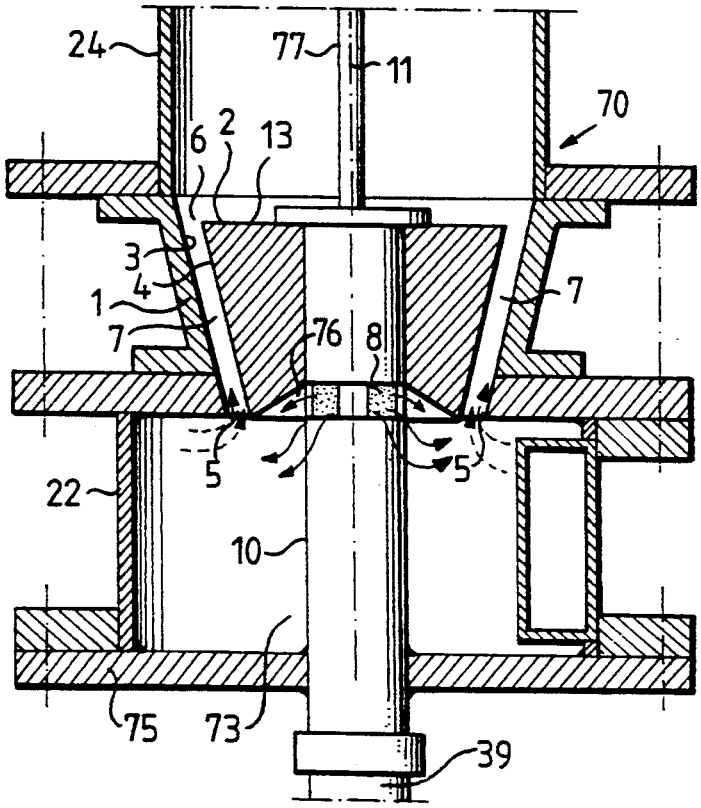
FIG. 7 is a longitudinal section through a fourth embodiment of the apparatus according to the invention.

The inner wall element 13 may be provided on the side facing away from the support member 10 with suitable centering means 77, connected to the wall element 13 and the corresponding end wall, such as the top wall 54 in the embodiment shown in FIG. 4. Such a centering means may suitably consist of a coaxially arranged telescopic tube arrangement if the wall element 13 is axially displaceable, or a rod if it is axially stationary as shown in FIG. 7. Besides providing precise centering in order to obtain an optimally adjusted, concentric annular gap, this centering means also counteracts the occurrence of any undesired oscillation, i.e. it has a stabilizing effect on the wall element 13.

The apparatus can be used for mixing pulp with any kind of fluid, such as gases in the form of ozone, oxygen and chlorine and liquids containing various active substances, e.g. chlorine dioxide. The apparatus is particularly useful for mixing large quantities of fluid into the pulp, e.g. gas amounts in excess of 50% of the total flow volume.

It is claimed:

1. An apparatus for mixing a suspension of cellulosic fibrous material and a fluid comprising a housing having a center line, an inlet and an outlet for the fiber suspension, said inlet and said outlet being spaced apart axially from each other along said center line of said housing, a fluid inlet and two cooperating walls in said housing at a distance from each other, said walls having sides facing each other to define a gap through which the fiber suspension will flow, said apparatus including a gap inlet opening for the suspension and a gap outlet opening, each respectively in communication with said inlet and outlet for the fiber suspension, wherein said walls are disposed concentrically in said housing and are non-rotatable, said sides of said walls extending around said center line of said housing and spaced therefrom, said gap having the shape of a concentric annular space having an extension greater than 20 mm in the main flow direction of the medium and wherein said housing includes a distribution chamber in communication with and axially upstream of said annular gap to distribute the fiber suspension uniformly around the entire concentric inlet opening of said annular gap.

2. An apparatus as claimed in claim 1, characterized in that, seen in a longitudinal section through the housing, the annular gap (7) extends substantially linearly between the inlet opening (5) and the outlet opening (6) in a direction forming an angle of in excess of 0° up to 90°, with the center line (11) of the apparatus, said direction corresponding to the flow direction of the fibre suspension through the annular gap (7), so that the diameter of the annular gap (7) increases in the direction of flow of the pulp.

3. An apparatus as claimed in claim 2, characterized in that the wall means (1, 2) are arranged radially outside each other to form a radially outer wall element (12) and a radially inner wall element (13), whereupon the annular gap (7) has from cylindrical to conical shape measured at a mid-line through the annular gap (7).

4. An apparatus as claimed in claim 3, characterized in that the through-flow area of the annular gap (7) increases from its inlet opening (5) to its outlet opening (6).

5. An apparatus as claimed in claim 4, characterized in that the inner wall element (13) is supported by a coaxially arranged, elongate support member (10), slidingly journalled at one end of the housing to permit axial displacement of the inner wall element (13) in relation to the outer wall element (12), and that the apparatus includes an actuator (55) cooperating with the support member (10) to permit axial displacement of the inner wall element (13) in relation to the outer wall element (12) in order to adjust or control the through-flow area of the annular gap (7).

6. An apparatus as claimed in claim 5, characterized in that said apparatus also includes a control device (66) arranged to measure the difference between the pressure in the fibre suspension upstream and downstream of the inlet and outlet openings (5, 6) of the annular gap (7) and to effect displacement of the inner wall element (13) in one direction or the other depending on the pressure difference measured in relation to a predetermined value.

7. An apparatus as claimed in claim 6, characterized in that the actuator comprises a stationary fluid cylinder (56) containing a piston rod (38) which is coaxial with the support member (10), that the pressure side of the cylinder (56) is connected to an accumulator (60) and a safety valve (62), and that the control device controls a valve (64) in a conduit (63) to open or close the supply of pressure medium to the pressure side of the cylinder (56) depending on the continuously measured pressure difference in relation to the predetermined value.

8. An apparatus as claimed in claim 7, characterized in that at least one of the facing sides (3, 4) of the wall means (1, 2) is provided with at least one protuberance (53) and at least one recess extending transversely to the flow direction of the fibre suspension in order to effect turbulence in the fibre suspension.

9. An apparatus as claimed in claim 8, characterized in that the inlet means (8) for the supply of fluid is arranged at one point in the apparatus upstream of the outlet opening (6) of the annular gap (7).

10. An apparatus as claimed in claim 9, characterized in that the inlet means (8) is arranged in at least one of the wall means (1, 2) and in the distribution chamber (73) and in the inlet (71) to the distribution chamber (73).

11. An apparatus as claimed in claim 10, characterized in that both wall elements (12, 13) are provided with inlet means (8) for the supply of fluid, that the inlet means (8) include distribution means (9) arranged to distribute fluid from the sides (3, 4) of the wall elements at least within a section of each side (3, 4) extending continuously in a direction transverse to the flow direction of the fibre suspension so that fluid is supplied to all the fibre suspension passing along the sides (3, 4) of the wall elements (12, 13) through the annular gap.

12. An apparatus as claimed in claim 11, characterized in that the distribution means (9) comprises a dosage ring (35, 36) arranged concentrically in a wall element (12, 13), which is pervious to fluid in order to dose fluid to the gap (7) transversely to the flow direction of the fibre suspension.

13. An apparatus as claimed in claim 5, characterized in that the support member (10) and the piston rod (38) are hollow, that the piston rod (38) is connected to a conduit (39) for the supply of fluid from an external supply to the inlet means (8) via the piston rod (38) and support member (10), said inlet means (8) being arranged in the inner wall element (13) and in the support member (10) in connection with the distribution chamber (73).

14. An apparatus as claimed in claim 13, characterized in that the inlet means (8) are provided with orifices (74) opening into the distribution chamber (73), said orifices (74) being distributed around the wall of the support member (10) at several points so that fluid is supplied to all the fibre suspension flowing towards the inlet opening (5) of the annular gap (7), one such point of orifices (74) being preferably arranged in close proximity to the inlet opening (5i of the annular gap (7).

15. An apparatus as claimed in claim 14, characterized in that the surface of the inner wall element (13) facing the distribution chamber (73) is recessed inwardly to produce an annular pocket (76), and that said orifices (74) of the inlet means (8) are arranged within this pocket (76) which peripherally passes to the inlet opening (5).

16. An apparatus as claimed in claim 2, characterized in that the wall means are arranged axially one after the other in order to form an axially outer wall element (12) located nearest said distribution chamber (73), and an axially inner wall element (13) spaced axially from the axially outer wall element (12), the annular gap (7) in this case being located in a plane substantially perpendicular to the center line (11) of the housing (70).

17. An apparatus as claimed in claim 3 or 16, characterized in that the inner wall element (13) is permanently joined to at least one of the opposing ends (54, 75) of the housing (70), the inner wall element thus also being axially immovable.

18. The method of mixing a suspension of cellulosic fibrous material and gas in a quantity of over 50% of the total flow volume comprising the step of using an apparatus for mixing the suspension of cellulosic fibrous material and a fluid comprising a housing having a center line and inlet and out for the fibrous suspension, said inlet and outlet being spaced axially from each other with respect to the center line of the housing, inlet means for the supply of said fluid to the fibrous suspension; two cooperating wall means arranged in the housing at a distance from each other, said wall means having sides facing each other which between them define an annular gap through which the fibrous suspension will flow and with the gap having an inlet opening and an outlet opening communicating with said inlet and said outlet, respectively, for the fiber suspension, wherein the wall means are arranged concentrically in the housing and are non-rotatable, said opposite sides thereof being arranged to extend around the center line of the housing, spaced therefrom, the gap thereby acquiring the shape of the concentric annular gap, which annular gap has an extension in access of 20 mm in the main flow direction of the medium flowing through it, wherein said housing includes a distribution chamber communicating with and being arranged axially upstream of said annular gap to distribute the fibrous suspension uniformly around the entire concentric inlet opening of said annular gap.

* * * * *